US006887536B2

(12) United States Patent
De Voeght et al.

(10) Patent No.: US 6,887,536 B2
(45) Date of Patent: May 3, 2005

(54) RECORDING ELEMENT FOR INK JET PRINTING

(75) Inventors: Frank De Voeght, Heist op den Berg (BE); Peter Slabbinck, Knokke-Heist (BE); Huub Van Aert, Pulderbos (BE)

(73) Assignee: AGFA Geveart, Mortsel (BE)

( * ) Notice: Subject to any disclaimer, the term of this patent is extended or adjusted under 35 U.S.C. 154(b) by 6 days.

(21) Appl. No.: 10/357,078

(22) Filed: Feb. 3, 2003

(65) Prior Publication Data

US 2003/0180479 A1 Sep. 25, 2003

Related U.S. Application Data

(60) Provisional application No. 60/367,884, filed on Mar. 27, 2002.

(30) Foreign Application Priority Data

Mar. 21, 2002 (EP) ..... 02100283

(51) Int. Cl.[7] ..... B41M 5/40

(52) U.S. Cl. ..... 428/32.36; 428/32.25; 428/32.29; 428/32.31

(58) Field of Search ..... 428/32.25, 32.29, 428/32.31, 32.34, 32.36

(56) References Cited

U.S. PATENT DOCUMENTS

| | | | | |
|---|---|---|---|---|
| 5,660,928 | A | 8/1997 | Stokes et al. | 428/331 |
| 6,214,458 | B1 * | 4/2001 | Kobayashi et al. | 428/32.5 |
| 6,338,891 | B1 * | 1/2002 | Kawasaki et al. | 428/32.31 |
| 6,502,935 | B1 * | 1/2003 | Barcock et al. | 347/105 |
| 2002/0192436 | A1 * | 12/2002 | Voeght et al. | 428/195 |
| 2003/0180478 | A1 * | 9/2003 | Fruge et al. | 428/31 |

FOREIGN PATENT DOCUMENTS

| | | |
|---|---|---|
| EP | 0 732219 | 9/1996 |
| EP | 1 080 935 | 3/2001 |

OTHER PUBLICATIONS

European Search Report for EP 02 10 0283, dated Aug. 12, 2002.

* cited by examiner

*Primary Examiner*—B. Shewareged
(74) *Attorney, Agent, or Firm*—Joseph T. Guy; Nexsen Pruet LLC

(57) ABSTRACT

An improved ink jet recording element is disclosed comprising a subbed polyester support, and an ink receiver layer containing a cationic compound, characterized in that between said support and said ink receiver layer there is an additional adhesion promoting layer present comprising a binder and a cationically modified silica.

37 Claims, No Drawings

RECORDING ELEMENT FOR INK JET PRINTING

REFERENCE TO RELATED APPLICATIONS

The application claims benefit of provisional application No. 60/367,884 filed Mar. 27, 2002.

FIELD OF THE INVENTION

The present invention relates to an improved recording element for ink jet printing.

BACKGROUND OF THE INVENTION

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor. In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in *Journal of Imaging Science and Technology* Vol. 42 (1), January/February 1998.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. Pat. Nos. 3,739,393, 3,805,273 and 3,891,121.

The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system). According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink jet typically include following ingredients: dyes or pigments, water and/or organic solvents, humectants such as glycols, detergents, thickeners, polymeric binders, preservatives, etc. It will be readily understood that the optimal composition of such an ink is dependent on the ink jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves primarely evaporation;
- hot melt or phase change: the ink vehicle is liquid at the ejection temperature but solid at room temperature; drying is replaced by solidification;
- UV-curable; drying is replaced by polymerization.

It is known that the ink-receiving layers in ink-jet recording elements must meet different stringent requirements:

- The ink-receiving layer should have a high ink absorbing capacity, so that the dots will not flow out and will not be expanded more than is necessary to obtain a high optical density.
- The ink-receiving layer should have a high ink absorbing speed (short ink drying time) so that the ink droplets will not feather if smeared immediately after applying.
- The ink dots that are applied to the ink-receiving layer should be substantially round in shape and smooth at their peripheries. The dot diameter must be constant and accurately controlled.
- The receiving layer must be readily wetted so that there is no "puddling", i.e. coalescence of adjacent ink dots, and an earlier absorbed ink drop should not show any "bleeding", i.e. overlap with neighbouring or later placed dots.
- Transparent ink-jet recording elements must have a low haze-value and be excellent in transmittance properties.
- After being printed the image must have a good resistance regarding water-fastness, light-fastness, and good endurance under severe conditions of temperature and humidity.
- The ink jet recording element may not show any curl or sticky behaviour if stacked before or after being printed.
- The ink jet recording element must be able to move smoothly through different types of printers.

All these properties are often in a relation of trade-off. It is difficult to satisfy them all at the same time.

When the finished ink jet image is meant to be transparent, e.g. for use in overhead projection or for use in a medical diagnostic hardcopy, it is necessary to use a transparent polymeric film (which may contain a colorant depending on the application) as support for the ink jet recording element. A well-known polymeric film for use as support in many fields of technology and especially in different types of image recording is a polyester, such as polyethylene terephthalate (PET) and polyethylene naphthalate (PEN). A problem when using such supports for ink receiving layers is the criticallity of the so-called "adhesion dry" property. This means that on further handling of the finished ink jet image, e.g. by preparing it for use as a master for the exposure of a printing plate, the ink receiver layer tends to get loose from the polyester support. When this phenomenon occurs in several areas the finished image gets a crumpled outlook and becomes unsuitable for use as a master, or parts of the image get lost which results in a loss of valuable information. In photographic industry where PET is widely used as support for photographic film the problem of the bad adhesion between the hydrophobic PET and the hydrophilic light-sensitive layer(s) is solved by providing the PET support with at least one and preferably two so-called subbing layers. However, it was found experimentally that this measure did not solve completely the problem of insufficient "adhesion dry" when typical ink receiver compositions are coated on a polyester support.

SUMMARY OF THE INVENTION

The present invention seeks to remedy the problem of insufficient adhesion in dry state when subbed polyester is used as support for a typical ink receiver layer.

The above-mentioned desired advantageous effect is realised by providing an ink jet recording material comprising a subbed polyester support, and an ink receiver layer containing a cationic compound, characterized in that between said support and said ink receiver layer there is an additional adhesion promoting layer present comprising a binder and a cationically modified silica.

Further advantages and embodiments of the present invention will become apparent from the following description.

DETAILED DESCRIPTION OF THE INVENTION

The Subbed Polyester Support

The support of the ink jet recording material used in accordance with the present invention is a transparent polyester support, e.g. a polyethylene terephthalate or polyethylene naphthalate support. Polyethylene terephthalate (PET) is the preferred support. This support is coated on at least one side with a so-called subbing layer as is well known from photographic technology. Preferably, the polyester is subbed with two subbing layers, a so-called latex subbing layer and a so-called gelatin subbing layer. An essential ingredient of the latex subbing layer is an adhesion promoting latex. A preferred class of latex polymers for this purpose are vinylidene chloride-containing copolymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the monomethylester of itaconic acid, (3) terpolymers of vinylidene chloride, itaconic acid and an alkyl acrylate or methacrylate such as ethyl acrylate or methyl methacrylate, and (4) terpolymers of vinylidene chloride, acrylonitrile or methacrylonitrile and an unsaturated carboxylic acid such as acrylic acid or methacrylic acid.

In a most preferred embodiment the latex polymer is co(vinylidene chloride-methyl acrylate-itaconic acid; 88%/10%/2%). This copolymer is prepared by emulsion polymerization using 0.5% MERSOLAT H (trade-mark of Bayer AG) as emulsifying agent. It is necessary to add extra surfactant, a so-called post-stabilizer, to the latex in order to assure a good stability on storage. An excellent storage stability is obtained when 4% of ULTRAVON W, trade mark of Ciba-Geigy, or DOWFAX, trade mark of Dow, is used.

As a further preferred ingredient of the coating solution of the latex subbing layer colloidal silica may be added. A preferred compound is KIESELSOL 100F (trade-mark of Bayer AG), average particle size 25–30 nm. The ratio of the amount of latex to silica is preferably about 80/20.

The latex subbing layer may further contain surfactants and biocides.

As already stated above, there is preferably also a so-called gelatin subbing layer on top of the latex subbing layer. Typically, this gelatin subbing layer contains a mixture of gelatin and colloidal silica. A preferred compound is again KIESELSOL 300F (trade-mark of Bayer AG). A plasticizing compound can be used in order to avoid the formation of cracks in the dried layer due to the occurence of excessive shrinking of the layer during drying. Plasticizing agents are well-known in the art. Low-molecular weight compounds (e.g. acetamide, glycerin) as well as polymeric latices (e.g. polyethylacrylate, poly-n.-butylacrylate) can be used for this purpose. Furtheron the gelatin subbing layer may contain one or more surfactants. Useful surfactants include: ULTRAVON™ W, an aryl sulfonate from CIBA-GEIGY, DOWFAX from Dow CO., and ARKOPAL™ N060 (previously HOSTAPAL™ W), a nonylphenylpolyethyleneglycol from HOECHST.

The subbing layers may be present on just one side of the polyester support or they may also be present on the back side when the ink jet recording medium is provided with one or more backing layers, such as an anti-curl layer, or an electroconductive layer.

The Adhesion Promoting Layer

It is essential to the present invention that between the subbed polyester support and the ink receiver layer there is an extra adhesion promoting layer comprising a binder and a cationically modified silica.

The binder can be chosen from a list of compounds well-known in the art including hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinylacetal; polyvinyl pyrrolidone; polyacrylamide; acrylamide/acrylic acid copolymer; poly(styrene), styrene copolymers; acrylic or methacrylic polymers; styrene/acrylic copolymers; ethylene-vinylacetate copolymer; vinylmethyl ether/maleic acid copolymer; poly(2-acrylamido-2-methyl propane sulfonic acid); poly(diethylene triamine-co-adipic acid); polyvinyl pyridine; polyvinyl imidazole; polyimidazoline quaternized; polyethylene imine epichlorohydrin modified; polyethylene imine ethoxylated; poly(N, N-dimethyl-3,5-dimethylene piperidinium chloride; polyethylene oxide; polyurethane; melamine resins; gelatin; carrageenan; dextran; gum arabic; casein; pectin; albumin; starch; collagen derivatives; collodion and agar-agar.

A preferred binder for the practice of the present invention is a polyvinylalcohol (PVA), a vinylalcohol copolymer or modified polyvinyl alcohol. Most preferably, the polyvinyl alcohol is a cationic type polyvinyl alcohol, such as the cationic polyvinyl alcohol grades from Kuraray, such as POVAL C506, POVAL C118, and from Nippon Goshei. Furthermore cationic polyvinyl alcohol may be obtained by several routes:

1) copolymerisation of vinyl acetate with a cationic monomer and subsequent hydrolysis. Preferred cationic monomers are quaternary ammonium salts or phosponium salts, such as methacryloxy ethyl trimethyl ammonium chloride, diallyl dimethylammonium chloride, ect. Examples of such copolymerisations are described in the following reference:

Functional modification of poly(vinyl alcohol) by copolymerization. III. Modification with cationic monomers. Moritani, Tohei; Yamauchi, Junnosuke. Technical Research Center, Kuraray Company, Okayama, Japan. Polymer (1998), 39(3), 559–572.

2) copolymerisation of a precursor for a cationic monomer with vinyl acetate and subsequent hydrolysis. Precursors for a cationic monomer include primary amines, secondary amines and tertairy amines, which become cationic after protonation, e.g. 2-(dimethylamino)ethyl methacrylate. Other precursors for cationic monomers are precursors for amino functional monomers such as vinyl acetamide. This route towards amino functional PVA is described in the following patents:

Manufacture of vinyl alcohol polymers by saponification. Fujiwara, Naoki; Sato, Kazuaki; Matsumoto, Yoichi; Nakahara, Fumio. (Kuraray Co., Ltd., Japan). JP-A 2001081128

Amine-functional poly(vinyl alcohol) for improving properties of recycled paper. Robeson, EP 617166

Preparation of cationic poly(vinyl alcohol). Noguchi, Yasunori; Kadota, Takashi. (Sakamoto Yakuhin Kogyo Co., Ltd., Japan). JP-A 03281607

Preparation of cationic derivatives of poly(vinyl alcohol). Stober, Reinhard; Kohn, Ellen; Bischoff, Dietmar. (Degussa A.-G., Fed. Rep. Ger.). DE 3626662 C1

3) Derivatization of polyvinylalcohol yielding amino, quaternary ammonium or quaternary phosphonium functional polymers, e.g. via esterification, etherification or acetalisation. Useful reagents for this purpose are e.g. 4-aminobutyraldehyde dimethyl acetal, aminoacetaldehyde, glycidyltrimethylammonium chloride, ect. Examples of such modifications are described in the following patents:

Paper wet-strength improvement with cellulose reactive size and amine-functional poly(vinyl alcohol) and paper from. Robeson, Lloyd M.; Davidowich, George; Pinschmidt, Robert K., Jr. (Air Products and Chemicals, Inc., USA). U.S. Pat. No. 5,397,436

Photographic film with improved light stability. Helling, Guenter; Peters, Manfred. (Agfa-Gevaert AG, Germany). Ger. Offen. (1996), DE 4438004 Al 19960502

Photographic recording material. Helling, Guenter; Dewanckele, Jean-Marie. (Agfa-Gevaert AG, Germany). EP 627656

4) An amino modified polyvinylalcohol prepared from a graft copolymerisation of amino-modified monomers with polyvinyl alcohol. The amino-functional monomer can have primairy, secondary, tertiary or quaternary amine groups. An example of a such graft copolymerisations is described in:

Ink receptive coating compositions containing poly(vinyl alcohol) grafted with amine functional groups. Rabasco, John Joseph; Klingenberg, Eric Howard; Boylan, John Richard. (Celanese International Corporation, USA). WO 01/74599

Graft polymers based on vinyl ester and/or alcohol polymers and ethylenically unsaturated monomers, their preparation and their use. Denzinger, Walter; Ruebenacker, Martin; Nilz, Claudia; Lorencak, Primoz; Moench, Dietmar; Schuhmacher, Rudolf; Stange, Andreas. (BASF AG., Germany). DE 19526626

Silica as pigment in ink receiving elements is disclosed in numerous old and recent patents, e.g. U.S. Pat. Nos. 4,892,591, 4,902,568, EP 373573, EP 423829, EP 487350, EP 493100, EP 514633, etc. The silica, before cationic modification, can be chosen from different types, such as crystalline silica, amorphous silica, precipitated silica, fumed silica, silica gel, spherical and non-spherical silica. The silica may contain minor amounts of metal oxides from the group Al, Zr, Ti. Useful types include AEROSIL OX50 (BET surface area 50±15 $m^2/g$, average primary particle size 40 nm, $SiO_2$ content >99.8%, $Al_2O_3$ content <0.08%), AEROSIL MOX170 (BET surface area 170 $g/m^2$, average primary particle size 15 nm, $SiO_2$ content >98.3%, $Al_2O_3$ content 0.3–1.3%), AEROSIL MOX80 (BET surface area 80±20 $g/m^2$, average primary particle size 30 nm, $SiO_2$ content >98.3%, $Al_2O_3$ content 0.3–1.3%), or other hydrophilic AEROSIL grades available from Degussa-Hüls AG, which may give aqueous dispersions with a small average particle size (<500 nm). Cationically modified silica can be prepared by following methods, without meaning to be limitative:

(1) subjecting silica to a surface treatment with an inorganic cationic compound such as particular metal oxides and oxyhydroxides, e.g. aluminum oxides, and alumina hydrates such as boehmite and pseudo-boehmite; an example of such preparation route is described in the following reference:

Cationic silica dispersion for recording material. Field, Rex J.; Darsillo, Michael S.; Fluck, David J.; Laufhutte, Rudiger. (Cabot Corporation, USA). WO 00/20221

Ink jet recording element containing colloidal silica. Chu, Lixin; Romano, Charles Eugene, Jr.; Chen, Chen C. Eastman Kodak Co.) EP 983867

Recording medium excellent in ink absorptivity and process for its production, and process for producing silica-alumina composite sol. Nakahara, Katsumasa; Inokuma, Hisao; Hirano, Hachirou; Matsubara, Toshiya; Wakabayashi, Masako; Kon, Yoshinori. (Asahi Glass Company Ltd., Japan). EP 1112962 A1

Ink-receptive coating for ink-jet recording material. Chapman, David Monroe. (W. R. Grace & Co.-Conn., USA). WO 00/02736

In a preferred embodiment of the present invention the silica is modified by means of pseudo-boehmite. Pseudo-boehmite is also called boehmite gel and is fine particulate alumina hydrate having a needle form. The composition thereof is generally represented by $Al_2O_3 \cdot 1.5–2H_2O$ and differs from that of crystalline boehmite.

(2) by subjecting silica to a surface treatment with an organic compound having both an amino group or quaternary ammonium group thereof or a quaternary phosphonium group, and a functional group having reactivity to a silanol group on the surface of silica, such as aminoalkoxysilane or aminoalkyl glycidyl ether or isopropanol amine, examples of such preparation routes are described in:

Ink-jet printing ink-accepting compositions comprising cation-modified silica, vinyl polymers and cationic polymers for printing fabrics using ink-jet printers with high color depth and printing fabrics coated or impregnated with the compositions. Yasuda, Masahiro; Okudo, Toshifumi; Hirota, Yasuhide. (Kyoeisha Chemical Co., Ltd., Japan). JP-A 2000265380

Ink-jet-printable image-transfer medium, process for transferring image, and cloth imaged by this process. Sato, Yuko; Higuma, Masahiko; Shino, Yoshiyuki. (Canon Kabushiki Kaisha, Japan). EP 933225 A1

Adsorption of cationic surfactants on highly dispersed silica. Mikhailova, I. V.; Gerashchenko, I. I. Institute of Surface Chemistry, National Academy of Sciences of Ukraine, Kiev, Ukraine. Colloid J. (2001), 63(4), 437–440.

Functionalization of silica particles towards cationic polyelectrolytes using vinylformamide and 1,3-divinylimidazolidin-2-one as monomers. Meyer, Torsten; Rehak, Petra; Jager, Christian; Voigt, Ina; Simon, Frank; Spange, Stefan. Polymer Chemistry, Institute for Chemistry, Chemnitz University of Technology, Chemnitz, Germany. Macromol. Symp. (2001), 163 (Tailormade Polymers), 87–96.

Image receiving element and method of manufacturing the element. Yarmey, Susan K.; Steiner, Michael L. (Imation Corp., USA). WO 01/05599

Coated paper with good printability for ink-jet printing. Hirose, Mifune; Sakaki, Mamoru; Katayama, Masato; Higuma, Masahiko; Moriya, Kenichi; Nishioka, Yuko. (Canon K. K., Japan). EP 732219 A2

Manufacture of porous, laminar, inorganic products. Yokoyama, Masaru; Hirao, Shozo; Kishimoto, Takashi; Takahama, Koichi. (Matsushita Electric Works, Ltd., Japan). JP-A 62176969

(3) by polymerisation of a cationic or amino functional monomer in the presence of a silica, e.g. as descibed in:

Ink-jet printing sheet containing cationic silica. Ito, Hiroshi; Sawamoto, Hidetada; Hasegawa, Makoto. (Oji Paper Co., Ltd., Japan). JP-A 2001293948

Grafting of polymers with controlled molecular weight onto carbon black and ultrafine silica surface. Tsubokawa, Norio; Yoshikawa, Sachio. Department of Material Science and Technology, Faculty of Engineering, Niigata University, Niigata, Japan. Recent Res. Dev. Polym. Sci. (1998), 2(Pt. 2), 211–228.

Cationic polymer synthesis at inorganic surfaces. Spange, S. Inst. Org. Chem. Macromol. Chem., Jena Univ., Jena, Germany. Vysokomol. Soedin., Ser. A Ser. B (1993), 35(11), 1873–7.

The ratio cationized silica/binder in the adhesion promoting layer is preferably between 1:4 and 10:1.

The thickness of the adhesion promoting layer is preferably comprised between 1 and 6 g/m$^2$.

The Ink Receiving Layer

It is essential to the present invention that the ink receiver layer contains a cationic compound. This can be a cationic inorganic pigment, or a cationic polymer, or a mixture of both. In case the cationic compound is a cationic inorganic pigment then usually the ink receiver layer will further contain a binder which itself can be cationic or not. In case the cationic compound is a cationic polymer it can be a cationic film forming polymer, functioning as binder, such as cationic PVA, or it can be a non-film forming polymeric mordant, in which latter case a separate binder will usually be present which again can be cationic or not.

The term "cationic inorganic pigment" as used in the present invention means a substance composed of fine particles having a positive charge on their surfaces and therefore having adsorbability of acid substances such as acid dyes. Specific examples thereof include fine particles composed of oxides of metals such as magnesium, calcium, aluminum, zirconium, zinc, chromium, iron, copper, tin, lead and manganese.

Those having a negative charge on their surfaces like silica may also be used if they are surface-treated to change the negative charge on the surface to a positive charge (as already explained above for the silica in the adhesion promoting layer). Preferably the cationic substance is chosen from crystalline boehmite, or γ-AlO(OH), and cationized silica, and mixtures thereof. Boehmite is the most preferred cationic pigment since it allows a good transparency, meaning a low haze value, for the finished ink jet image. Useful types of boehmite include, in powder form, DISPERAL, DISPERAL HP14 and DISPERAL 40 from Sasol, MARTOXIN VPP2000-2 and GL-3 from Martinswerk GmbH.; liquid boehmite alumina systems, e.g. DISPAL 23N4-20, DISPAL 14N-25, DISPERAL AL25 from Sasol. Patents on alumina hydrate include EP 500021, EP 634286, U.S. Pat. No. 5,624,428, EP 742108, U.S. Pat. No. 6,238,047, EP 622244, EP 810101, etc. Other useful cationic inorganic pigments include aluminum oxide (alumina), e.g. $\alpha$-$Al_2O_3$ types, such as NORTON E700, available from Saint-Gobain Ceramics & Plastics, Inc, $\gamma$-$Al_2O_3$ types, such as ALUMINUM OXID C from Degussa; other aluminum oxide grades, such as BAIKALOX CR15 and CR30 from Baikowski Chemie; DURALOX grades and MEDIALOX grades from Baikowski Chemie, BAIKALOX CR80, CR140, CR125, B105CR from Baikowski Chemie; CAB-O-SPERSE PG003 tradeamrk from Cabot, CATALOX GRADES and CATAPAL GRADES from from Sasol, such as PLURALOX HP14/150; colloidal $Al_2O_3$ types, such as ALUMINASOL 100; ALUMINASOL 200, ALUMINASOL 220, ALUMINASOL 300, and ALUMINASOL 520 trademarks from Nissan Chemical Industries or NALCO 8676 trademark from ONDEO Nalco.

Other useful cationic inorganic pigments include aluminum trihydroxides such as Bayerite, or $\alpha$-$Al(OH)_3$, such as PLURAL BT, available from Sasol, and Gibbsite, or $\gamma$-$Al(OH)_3$, such as MARTINAL grades from Martinswerk GmbH, MARTIFIN grades, such as MARTIFIN OL104, MARTIFIN OL 107 and MARTIFIN OL111 from Martinswerk GmbH MICRAL grades, such as MICRAL 1440, MICRAL 1500; MICRAL 632; MICRAL 855; MICRAL 916; MICRAL 932; MICRAL 932CM; MICRAL 9400 from JM Huber company; HIGILITE grades, e.g. HIGILITE H42 or HIGILITE H43M from Showa Denka K.K., HYDRAL GRADES such as HYDRAL COAT 2, HYDRAL COAT 5 and HYDRAL COAT 7, HYDRAL 710 and HYDRAL PGA, from Alcoa Industrial Chemicals.

Another useful type of cationic pigment is zirconium oxide such as NALCO OOSS008 trademark of ONDEO Nalco, acetate stabilized $ZrO_2$, ZR20/20, ZR50/20, ZR100/20 and ZRYS4 trademarks from Nyacol Nano Technologies.

Useful mixed oxides are SIRAL grades from Sasol, colloidal metaloxides from Nalco such as Nalco 1056, Nalco TX10496, Nalco TX11678.

When the cationic compound present in the ink receiver layer is a cationic polymer it can be a cationic film forming binder such as a cationic polyvinyl alcohol, a cationic cellulose ether, a cationic polyurethane, and mixtures thereof.

Alternatively, the cationic polymer can be a cationic mordant. Such substances increase the capacity of the layer for fixing and holding the dye of the ink droplets. A particularly suited compound is a poly (diallyldimethylammonium chloride) or, in short, a poly (DADMAC). These compounds are commercially available from several companies, e.g. Aldrich, Nalco, CIBA, Nitto Boseki Co., Clariant, BASF and EKA Chemicals.

Other useful cationic compounds include DADMAC copolymers such as copolymers with acrylamide, e.g NALCO 1470 trade mark of ONDEO Nalco or PAS-J-81, trademark of Nitto Boseki Co., such as copolymers of DADMAC with acrylates, such as Nalco 8190, trademark of ONDEO Nalco; copolymers of DADMAC with $SO_2$, such as PAS-A-1 or PAS-92, trademarks of Nitto Boseki Co., copolymer of DADMAC with maleic acid, e.g. PAS-410, trademark of Nitto Boseki Co., copolymer of DADMAC with diallyl(3-chloro-2-hydroxypropyl)amine hydrochloride, eg. PAS-880, trademark of Nitto Boseki Co., dimethylamine-epichlorohydrine copolymers, e.g. Nalco 7135, trademark of ONDEO Nalco or POLYFIX 700, trade name of Showa High Polymer Co.; other POLYFIX grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine, and REDIFLOC 4150, trade name of EKA Chemicals, a polyamine; MADAME (methacrylatedimethylaminoethyl=dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic acrylic polymers, such as ALCOSTAT 567, trademark of CIBA, cationic cellulose derivatives such as CELQUAT L-2OO, H-1OO, SC-240C, SC-230M, trade names of Starch & Chemical Co., and QUATRISOFT LM200, UCARE polymers JR125, JR400, LR400, JR30M, LR30M and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, trade name of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; phosphonium compounds such as disclosed in EP 609930 and other cationic polymers such as NEOFIX RD-5, trademark of Nicca Chemical Co.

The ink receiving layer, the adhesion promoting layer, and the optional backing layer may further contain well-known conventional ingredients, such as surfactants serving as coating aids, hardening agents, plasticizers, whitening agents and matting agents. Surfactants may be incorporated in the layers of the recording element of the present invention. They can be any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, α-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$–$C_{10}$ alkylcarboxylic acids, disodium N-perfluorooctanesulfonyl glutamate, sodium 3-(fluoro-$C_6$–$C_{11}$-alkyloxy)-1-$C_3$–$C_4$ alkyl sulfonates, sodium 3-(ω-fluoro-$C_6$–$C_8$-alkanoyl-N-ethylamino)-1-propane sulfonates, N-[3-(perfluorooctanesulfonamide)-propyl]-N,N-dimethyl-N-carboxymethylene ammonium betaine, fluoro-$C_{11}$–$C_{20}$ alkylcarboxylic acids, perfluoro-$C_7$–$C_{13}$-alkyl-carboxylic acids, perfluorooctane sulfonic acid diethanolamide, Li, K and Na perfluoro-$C_4$–$C_{12}$-alkyl sulfonates, N-propyl-N-(2-hydroxyethyl)perfluorooctane sulfonamide, perfluoro-$C_6$–$C_{10}$-alkylsulfonamide-propyl-sulfonyl-glycinates, bis-(N-perfluorooctylsulfonyl-N-ethanolaminoethyl) phosphonate, mono-perfluoro $C_6$–$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimoniumchloride phosphate, palmityl trimethylammonium chloride, and cetyltrimethylammonium bromide.

Especially useful are the fluorocarbon surfactants as described in e.g. U.S. Pat. No. 4,781,985, having a structure of: $F(CF_2)_{4\text{-}9}CH_2CH_2SCH_2CH_2N^+R_3X^-$ wherein R is a hydrogen or an alkyl group; and in U.S. Pat. No. 5,084,340, having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms. These surfactants are commercially available from DuPont and 3M. The concentration of the surfactant component in the ink-receiving layer is typically in the range of 0.1 to 2%, preferably in the range of 0.4 to 1.5% and is most preferably 0.75% by weight based on the total dry weight of the layer.

The ink-receiving layer, the adhesion promoting layer, and the optional auxiliary layers may be crosslinked to provide such desired features as waterfastness and non-blocking characteristics. The crosslinking is also useful in providing abrasion resistance and resistance to the formation of fingerprints on the element as a result of handling. There are a vast number of known crosslinking agents—also known as hardening agents—that will function to crosslink film forming binders. Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulfonate esters, active halogen compounds, isocyanate or blocked isocyanates, polyfunctional isocyanates, melamine derivatives, s-triazines and diazines, epoxides, active olefins having two or more active bonds, carbodiimides, zirconium complexes, e.g. BACOTE 20, ZIRMEL 1000 or zirconium acetate, trademarks of MEL Chemicals, titanium complexes, such as TYZOR grades from DuPont, isoxazolium salts subsituted in the 3-position, esters of 2-alkoxy-N-carboxy-dihydroquinoline, N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly(acroleinmethacrylic acid), and oxazoline functional polymers, e.g. EPOCROS WS-500, and EPOCROS K-1000 series, and maleic anhydride copolymers, e.g. GANTREZ AN119

In the practice of this invention boric acid is a preferred crosslinker.

The ink-receiving layer, the adhesion promoting layer and the optional auxiliary layers comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone.

The different layers may also comprise ingredients to improve the lightfastness of the printed image, such as antioxidants, UV-absorbers, peroxide scavengers, singlet oxygen quenchers such as hindered amine light stabilizers, (HALS compounds) etc . . . Stilbene compounds are a preferred type of UV-absorber.

The different layers can be coated onto the support by any conventional coating technique, such as dip coating, knife coating, extrusion coating, spin coating, slide hopper coating and curtain coating.

The present invention will now be illustrated by the following examples without however being limited thereto.

EXAMPLES

Example 1

The PET support used for the experiments carried on the front side a latex subbing layer comprising co(vinylidene chloride—methyl acrylate—itaconic acid; 88%/10%/2%) and colloidal silica KIESELSOL F, trade name of Bayer AG, and a gelatin subbing layer comprising gelatin and KIESELSOL F. On the back side the PET carried an analogous latex subbing layer and furtheron an electroconductive backing layer comprising a poly(3,4-ethylenedioxythiophene)/polystyrene sulphonate electroconductive complex.

For each sample the ink receiver layer had following composition:

- 25 g/m$^2$ of boehmite pigment, DISPERAL HP 14/2, trade mark of Sasol Co.;
- 2 g/m$^2$ of cationic polyvinyl alcohol, GOHSEFIMER K210, from Nippon Goshei Co.;
- 0.2 g/m$^2$ of boric acid as crosslinker.

When coating this composition directly onto the described subbed PET support a very bad adhesion was obtained.

When seeking to improve the adhesion, following adhesion promoting layers were coated between the subbed PET and the described ink receiver layer:

- Sample 1: 2 g/m$^2$ of colloidal silica LUDOX CL (from Grace Co.), pH 4.5, average particle size 12 nm; 1 g/m$^2$ of GOHSEFIMER K210; 0.1 g/m$^2$ of boric acid;
- Sample 2: 2 g/m$^2$ of alumina CAB-O-SPERSE PG003 (from Cabot Co.), pH 4.5, average particle size 160 nm; 1 g/m$^2$ of GOHSEFIMER K210; 0.1 g/m$^2$ of boric acid;
- Sample 3: 2 g/m$^2$ of pseudo-boehmite DISPERAL P3 (from Sasol Co.), average particle size 5–20 nm; 1 g/m$^2$ of GOHSEFIMER K210; 0.1 g/m$^2$ of boric acid;
- Sample 4: 2 g/m$^2$ of silica AEROSIL OX50 (from Degussa-Hüls AG), cationically modified by means of pseudo-boehmite DISPERAL P3 in an amount of about 20% versus AEROSIL; 1 g/m$^2$ of GOHSEFIMER K210; 0.1 g/m$^2$ of boric acid.

The finished samples were evaluated for "adhesion dry" property by means of a manual test resulting in a qualitative evaluation scale (– bad, + good, ++ very good). The results of these tests are summarized in table 1.

TABLE 1

| Sample No. | adhesion dry evaluation |
|---|---|
| 1 | – |
| 2 | – |
| 3 | – |
| 4 | ++ |

As it is clear from table 1 only the sample with the cationically modified silica gives an improvement for adhesion.

Example 2

In this experiments sample 4 of the previous example was further elaborated by a concentration range of the modified silica. The results are summarized in table 2.

TABLE 2

| g/m$^2$ of silica/P3 | Evaluation adhesion dry |
|---|---|
| 0 | – |
| 0.25 | + |
| 0.5 | + |
| 1 | ++ |
| 2 | ++ |

Table 2 shows that 0.25 g/m$^2$ of cationized silica is sufficient to improve the adhesion.

Having described in detail preferred embodiments of the current invention, it will now be apparent to those skilled in the art that numerous modifications can be made therein without departing from the scope of the invention as defined in the appending claims.

What is claimed is:

1. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein said silica is cationically modified by subjecting it to a surface treatment with pseudo-boehmite.

2. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein said silica is cationically modified by subjecting it to a surface treatment with an organic compound having both an amino group or quaternary group thereof or a quaternary phosphonium group, and a functional group having reactivity to a silanol group on the surface of silica.

3. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein said silica is cationically modified by polymerization of a cationic or amino functional monomer in the presence of silica.

4. An ink jet recording material according to claim 1 wherein the binder in said adhesion promoting layer is cationic polyvinyl alcohol.

5. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein the cationically modified silica/binder ratio in said adhesion promoting layer is between 1:4 and 10:1.

6. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein the thickness of said adhesion promoting layer is comprised between 1 and 6 $g/m^2$.

7. An ink jet recording material according to claim 1 wherein the cationic compound present in the ink receiver layer is a cationic inorganic pigment.

8. An ink jet recording material according to claim 7 wherein said cationic pigment is chosen from the group consisting of aluminum oxides, aluminum hydroxides, alumina hydrates, aluminum silicates, and cationically modified silicas.

9. An ink jet recording material comprising a subbed polyester support, and an ink receiver layer containing a cationic compound, characterized in that between said subbed polyester support and said ink receiver layer there is an additional adhesion promoting layer present comprising a binder and a cationically modified silica wherein the cationic compound present in the ink receiver layer boehmite.

10. An ink jet recording material according to claim 1 wherein the cationic compound present in the ink receiver layer is a cationic polymer.

11. An ink jet recording material according to claim 10 wherein said cationic polymer is cationic polyvinyl alcohol.

12. An ink jet recording material according to claim 10 wherein said cationic polymer is poly (diallyldimethylammonium chloride).

13. An ink jet recording material according to claim 2 wherein the binder in said adhesion promoting layer is cationic polyvinyl alcohol.

14. An ink jet recording material according to claim 2 wherein the catioinic compound present in the ink receiving layer is a cationic inorganic pigment.

15. An ink jet recording material according to claim 14 wherein said cationic pigment is chosen from a group consisting of aluminum oxides, aluminum hydroxides, alumina hydrates, aluminum silicates and cationically modified silicas.

16. An ink jet recording material according to claim 2 wherein the cationic compound present in the ink receiver layer is a cationic polymer.

17. An ink jet recording material according to claim 16 wherein said cationic polymer is cationic polyvinyl alcohol.

18. An ink jet recording material according to claim 16 wherein said cationic polymer is poly (diallyldimethylammonium chloride).

19. An ink jet recording material according to claim 3 wherein the binder in said adhesion promoting layer is cationic polyvinyl alcohol.

20. An ink jet recording material according to claim 3 wherein the cationic compound present in the ink receiver layer is cationic inorganic pigment.

21. An ink jet recording material according to claim 20 wherein said cationic pigment is chosen from the group consisting of aluminum oxides, aluminum hydroxides, alumina hydrates, aluminum silicates and cationically modified silicas.

22. An ink jet recording material according to claim 3 wherein the cationic compound present in the ink receiver layer is cationic polymer.

23. An ink jet recording material according to claim 22 wherein said cationic polymer is cationic polyvinyl alcohol.

24. An ink jet recording material according to claim 22 wherein said cationic polymer is poly (diallyldimethylammonium chloride).

25. An ink jet recording material according to claim 5 wherein the binder in said adhesion promoting layer is cationic polyvinyl alcohol.

26. An ink jet recording material according to claim 5 wherein the cationic compound present in the ink receiver layer is a cationic inorganic pigment.

27. An ink jet recording material according to claim 26 wherein said cationic pigment is chosen from the group consisting of aluminum oxides, aluminum hydroxides, alumina hydrates, aluminum silicates and cationically modified silicas.

28. An ink jet recording material according to claim 5 wherein the cationic compound present in the ink receiver layer is a cationic polymer.

29. An ink jet recording material according to claim 28 wherein said cationic polymer is cationic polyvinyl alcohol.

30. An ink jet recording material according to claim 28 wherein said cationic polymer is poly (diallyldimethylammonium chloride).

31. An ink jet recording material according to claim 6 wherein the binder in said adhesion promoting layer is cationic polyvinyl alcohol.

32. An ink jet recording material according to claim 6 wherein the cationic compound present in the ink receiver layer is cationic inorganic pigment.

33. An ink jet recording material according to claim 32 wherein said cationic pigment is chosen from the group consisting of aluminum oxides, aluminum hydroxides, alumina hydrates, aluminum silicates and cationically modified silicas.

34. An ink jet recording material according to claim 6 wherein the cationic compound present in the ink receiver layer is a cationic polymer.

35. An ink jet recording material according to claim 34 wherein said cationic polymer is cationic polyvinyl alcohol.

36. An ink jet recording material according to claim 34 wherein said cationic polymer is poly (diallyldimethylammonium chloride).

37. An ink jet recording material according to claim 9 wherein the binder in said adhesion promoting layer is cationic polyvinyl alchol.

* * * * *